United States Patent [19]

Armand et al.

[11] 4,164,420

[45] Aug. 14, 1979

[54] MASTER ALLOY FOR THE PREPARATION OF ZIRCONIUM ALLOYS

[75] Inventors: Marcel Armand; Daniel Charquet, both of Albertville, France

[73] Assignee: Ugine Aciers, Paris, France

[21] Appl. No.: 858,645

[22] Filed: Dec. 8, 1977

[30] Foreign Application Priority Data

Jan. 7, 1977 [FR] France ..... 77 00944

[51] Int. Cl.[2] ..... C22C 13/00

[52] U.S. Cl. ..... 75/175 R; 75/10 C; 75/135; 75/177

[58] Field of Search ..... 75/177, 175 R, 10 R, 75/10 C, 135

[56] References Cited

U.S. PATENT DOCUMENTS 2,772,964 12/1956 Thomas et al. ..... 75/77

3,664,825 5/1972 Bergqvist et al. ..... 75/77

FOREIGN PATENT DOCUMENTS 1084030 6/1960 Fed. Rep. of Germany ..... 75/177

*Primary Examiner*—M. J. Andrews

*Attorney, Agent, or Firm*—Dennison, Dennison, Meserole & Pollack

[57] ABSTRACT

The invention relates to a master alloy intended for the preparation of zirconium-base alloys and more particularly for the preparation of alloys such as those known as zircaloy 2 and zircaloy 4 useful for nuclear applications.

This master alloy contains, by weight, from about 50 to 85% of Sn; 5 to 30% of Zr; 0 to 20% of Fe; and 0 to 20% Cr, with the combined Fe+Cr content being about 3 to 30%.

This master alloy enables zirconium alloys to be produced in which the tin is distributed homogeneously.

5 Claims, No Drawings

MASTER ALLOY FOR THE PREPARATION OF ZIRCONIUM ALLOYS

The master alloy of the invention may be used for the production of all zirconium alloys, in the preparation of which it is necessary to add tin, and at least one element selected from iron and chromium.

The alloys prepared from this master alloy may contain other additions. This master alloy is particularly suitable for preparing the two zirconium alloys which are most frequently used at present and generally known as zircaloy 2 and zircaloy 4.

Zircaloy 2 contains, in % by weight:

Sn 1.2 to 1.7%, Fe 0.07 to 0.20%; Cr 0.05 to 0.15%; Ni 0.03 to 0.08%; and remainder Zr.

Zircaloy 4 contains:

Sn 1.2 to 1.7%; Fe 0.18 to 0.24%; Cr 0.07 to 0.13; and remainder Zr.

In the prior art these alloys are usually prepared using consumable-electrode arc-melting techniques. The introduction of alloying elements having a very low melting point, such as tin, makes the alloy heterogeneous. In fact, this tin, which is mixed with the other constituents of the consumable electrode, melts prematurely in the generally unmelted portion of the compacted electrode and tends to flow through the compacted electrode and into the ingot which has been forming in an ingot mold from beginning of the melting operation. Since the ingot is formed in a water cooled copper ingot mold only a small proportion of this ingot is maintained in the liquid state, thus preventing the ingot from being homogeneous at the end of the fusion process.

In order to prevent the tin from being distributed too heterogeneously, prior processes adopt various palliative measures, such as:

installing solid screens spaced regularly in the electrode; or using in the electrode a certain percentage of scraps of the alloy to be produced.

However, none of these solutions is completely effective and a high dispersion, or heterogeneity, still results.

It has also been suggested that tin be introduced into the consumable electrodes in the form of a binary master alloy ZrSn containing approximately 50% by weight of each of the two constituents.

This alloy, which is difficult to prepare since its melting point is higher than that of zirconium, requires suitable means of fusion such as a consumable-electrode argon fusion furnace and has the serious disadvantage of being extremely oxidizable, in particular when exposed to the humidity of the ambiant atmosphere. The alloy absorbes large quantities of water, causing it to disintegrate gradually and, in addition, the powders formed are pyrophoric and may ignite spontaneously. These characteristics make the alloy difficult to crush and hazardous to store.

Thus, when using this master alloy for producing zirconium-base alloys, considerable precautions have to be taken and, in any case, it is impossible to prevent the alloys obtained from having a certain degree of oxygen contamination. This contamination is not always acceptable.

The master alloy of the invention allows these disadvantages of the ZrSn binaries to be completely avoided. It also allows iron and/or chromium additions to be incorporated in the ingots and this is a real advantage in many cases. The melting point of this master alloy is considerably higher than that of tin and approaches the melting points of metals such as chromium and iron. This enables the phenomena of premature melting to be completely avoided, and in practice the zirconium is observed to melt almost simultaneously with this master alloy. In fact, the discrepancy between the melting temperatures is brought to values of between about 450° C. and 600° C. in the case of the master alloys of the invention, rather than being of the order of 1600° C. as in the case of pure tin. Tests have shown that this is quite acceptable and does not cause heterogeneity at the time of melting to form an ingot.

This master alloy may be produced easily, for example in an induction furnace, by melting its constituents in a vacuum or in a neutral atmosphere, or even in air. In the latter case, however, an oxide layer is formed on the surface of the liquid alloy, but the oxygen content of the body of the master alloy remains very low.

Finally, this master alloy has the advantages of being extremely stable in air under normal storage conditions and, at the same time, of being sufficiently brittle to be crushed, without difficulty, into grains having dimensions in the approximate range of from 5 to 20 mm in diameter.

The master alloy is incorporated in this divided form into the other constituents of the consumable electrode which, in turn, is subjected to arc fusion so as to form the ingot of zirconium alloy.

The general composition of this master alloy is as follows:

Sn 50 to 85% by weight
Zr 5 to 30% by weight
Fe 0 to 20% by weight
Cr 0 to 20% by weight
with the combined Fe+Cr being in the range of about 3 to 30%, by weight.

This master alloy also contains the impurities present in the raw materials used for its preparation. For nuclear applications, for example, it will be beneficial to select raw materials containing sufficiently small amounts of impurities to ensure that the products in which the master alloy will be incorporated conform to the prevailing standards.

It has been observed quite unexpectedly that the presence in the master alloy of small quantities of iron and/or of chromium make the master alloy stable and resistant to oxidization, properties which were lacking in the absence of one and/or the other of these two elements.

The tin, iron and/or chromium contents in these master alloys may be selected on the basis of the intended use of the compositions of the zirconium alloys and the composition of the raw materials. In fact, in many cases, the main raw material, zirconium sponge, may contain small quantities of iron, and furthermore, recovered scraps of zirconium alloys are frequently incorporated in the charge and these also contribute small quantities of iron and/or chromium and/or tin. Also, it is often desirable to provide the composition of the master alloy with Sn/Fe and/or Sn/Cr ratios which are different from those desired for the alloy to be produced. The Fe and Cr contents will subsequently be adjusted by adding these elements directly to the charge, taking into consideration the quantities which may be present in the raw materials and in the recovered scraps. However, the total quantity of tin to be added will preferably be introduced in the form of a master alloy.

The four following alloys may be quoted among the preferred compositions:

| | Sn % | Zr % | Fe % | Cr % |
|---|---|---|---|---|
| Alloy No. 1 | 70 | 20 | 10 | |
| Alloy No. 2 | 77 | 17.5 | 5.5 | |
| Alloy No. 3 | 70 | 20 | 5 | 5 |
| Alloy No. 4 | 77 | 17.5 | | 5.5 |

However, these compositions are only given by way of example, and it is preferable to adjust them as a function of the alloys to be produced and the raw materials to be used. Alloy No. 1 is the richest in iron, has the lowest melting point and has to be produced at about 1200° C. Alloys Nos. 2, 3 and 4 which contain less iron or which contain chromium have to be produced at about 1350° C.

The non-limiting example below compares an embodiment of the prior art with an embodiment of the invention with regard to the preparation of zirconium alloy known as zircaloy 4, the ranges of composition of which have been given above. Two ingots of zircaloy 4 have been prepared using zirconium sponge of nuclear quality, the iron content of which was 220 ppm. The Sn and Cr contents of this sponge were negligible. Two consumable electrodes labelled A and B respectively, each weighing 1080 kg approximately, were produced in a cylindrical shape, each being 2.7 m long and 320 mm in diameter.

These electrodes were formed from cylindrical sectors having an angle of 120° at the vertex, a radius of 160 mm, a height of 150 mm which were produced by compression using a press and these sectors were assembled by welding methods well known in the art.

In order to form each of the sectors of the electrode A of the prior art, 54 batches were weighed, each containing:

15.3 kg of Zr sponge
0.24 kg of Sn in granular form
0.003 kg of Fe in the form of pieces of wire
0.018 kg of Cr in granular form
4.4 kg of zircaloy 4 chips, of conventional composition.

Each batch was subsequently mixed carefully, then compressed using a press to the dimensions given above.

In order to form each of the sectors of the electrode B of the invention, 54 batches were weighed, each containing:

19.5 kg of zirconium sponge
0.388 kg of master alloy having the composition alloy no. 2
0.014 kg of Fe in the form of pieces of wire
0.023 kg of Cr in granular form Each batch was subsequently mixed then compressed in the same manner as for electrode A.

After assembling by welding the compressed parts formed each of the two electrodes A and B. The two electrodes were separately melted in a consumable-electrode vacuum arc furnace a conventional method, first in a 400 mm diameter crucible and then in a 500 mm diameter crucible.

The operations were carried out strictly under the same conditions. In particular, the two fusion processes were effected at a voltage of 30 volts and an intensity of 12500 amperes, and the fusion period was approximately 80 minutes.

Two ingots labelled LA and LB corresponding to the electrodes A and B respectively were thus obtained and were 500 mm in diameter, 840 mm long and weighed about 1080 kg. After removing the superficial crust, three samples were taken from the lateral surface of these ingots.

The first sample was taken at about 50 mm from the upper end.

The second sample was taken half way up.

The third sample was taken at about 50 mm from the bottom of the ingot.

The Sn, Fe, and Cr content of these samples were analyzed and the results obtained are given in the table below:

TABLE I

| Location of Sample Taken from Ingot | Elements analyzed: Sn LA | Sn LB | Fe LA | Fe LB | Cr LA | Cr LB |
|---|---|---|---|---|---|---|
| | Contents in % by weight | | | | | |
| Vicinity of the top of the ingot | 1.61 | 1.47 | 0.20 | 0.22 | 0.11 | 0.10 |
| Halfway up the ingot | 1.45 | 1.51 | 0.22 | 0.22 | 0.11 | 0.10 |
| Vicinity of the bottom of the ingot | 1.73 | 1.51 | 0.24 | 0.21 | 0.13 | 0.10 |

These analytical results show the very marked heterogeneous dispersion of the elements of ingot LA. With regard to the tin content, it can even be seen that this element is outside the desired range of composition for zircaloy 4 (Sn=1.2 to 1.7%) at one sample point in the ingot, even though this element was added in part in the form of zircaloy 4 chips. With regard to the other elements such as iron, there is also a heterogeneous distribution or dispersion, but this is less troublesome.

It is seen that for the ingot LB produced in accordance with the invention, the dispersions are much slighter and lie within the standard ranges.

The use of the master alloy of the invention therefore affords considerable advantages over the prior art methods while at the same time avoiding the serious disadvantages of the binary ZrSn alloys, caused by their oxidizability which makes them very awkward to produce. In addition, the master alloys according to the invention make it possible to improve not only the distribution of the tin, but also that of the iron and/or of the chromium.

These advantages are becoming particularly significant in view of the ever-increasing demands of the users of zirconium alloys, particularly for the construction of cannings for nuclear fuels, that make it necessary to produce Zr alloys having very precise compositions within limited ranges.

Finally, it is feasible to introduce additional alloying elements such as, for example, nickel to the master alloy if this is useful. These additions will be added as a function of the composition of the alloys which will be produced by means of the master alloy.

We claim:

1. A zirconium containing master alloy for producing zirconium-based alloys, said master alloy comprising by weight alloying elements of a percentage by weight generally greater than that of the zirconium-based alloys to be produced, and consisting essentially of by weight about:

Sn 50 to 85%
Zr 5 to 30%
Fe 0 to 20%

Cr 0 to 20% the combined Fe+Cr content of which is between about 3 and about 30%.

2. A master alloy for producing zirconium-based alloys essentially comprising by weight approximately:

Sn 70%; Zr 20%; Fe 10%

3. A master alloy for producing zirconium-based alloys essentially comprising by weight approximately:

Sn 77%; Zr 17.5%; Fe 5.5%

4. A master alloy for producing zirconium-based alloys essentially comprising by weight approximately:

Sn 70%; Zr 20%; Fe 5%; Cr 5%.

5. A master alloy for producing-zirconium based alloys essentially comprising by weight approximately:

Sn 77%; Zr 17.5%; Cr 5.5%.

* * * * *